US005125314A

United States Patent [19]

Chihana

[11] Patent Number: 5,125,314

[45] Date of Patent: Jun. 30, 1992

[54] AN ELECTRONIC MUSICAL INSTRUMENT HAVING SWITCHES FOR DESIGNATING MUSICAL TONE CONTROL DATA

[75] Inventor: Masanobu Chihana, Hamamatsu, Japan

[73] Assignee: Yamaha Corporation, Hamamatsu, Japan

[21] Appl. No.: 528,723

[22] Filed: May 24, 1990

[30] Foreign Application Priority Data

May 26, 1989 [JP] Japan ..... 1-133725

[51] Int. Cl.[5] ..... G10H 1/06; G10H 1/42; G10H 7/00

[52] U.S. Cl. ..... 84/601; 84/622; 84/635; 84/DIG. 12

[58] Field of Search ..... 84/601-646, 84/DIG. 12, DIG. 29

[56] References Cited

U.S. PATENT DOCUMENTS

| | | | |
|---|---|---|---|
| 4,448,104 | 5/1984 | Hoshii | 84/609 |
| 4,475,429 | 10/1984 | Suzuki | 84/609 X |
| 4,538,495 | 9/1985 | Sato | 84/622 |
| 4,984,497 | 1/1991 | Inagaki et al. | 84/626 |

FOREIGN PATENT DOCUMENTS 58-1833 1/1983 Japan .

*Primary Examiner*—Stanley J. Witkowski
*Attorney, Agent, or Firm*—Spensley, Horn Jubas & Lubitz

[57] ABSTRACT

An electronic musical instrument is disclosed in which the selection of timbre and rhythm contol functions is simplified, and the number of function switches and control panel surface area can be limited, even when the instrument has a large number of available timbre and rhythm control functions. The invention provides an electronic musical instrument employing various types of musical tone control data which are divided into groups. Additionally, the invention provides an input device which includes a plurality of switches, each switch corresponding to one of the above described groups of musical tone control data. The input device is capable of detecting the operation of the above mentioned switches. Additionally provided is a tone control data management device in which flag data is stored to indicate which of the above mentioned groups of musical tone control data have been selected, the flag data being updated any time one of the above mentioned switches corresponding to a group of musical tone control data has been operated. Also, a musical tone control device is provided such that based on the above mentioned flag data, musical tone control data is selected, and based on the selected musical tone control data, musical tone control is effected.

5 Claims, 6 Drawing Sheets

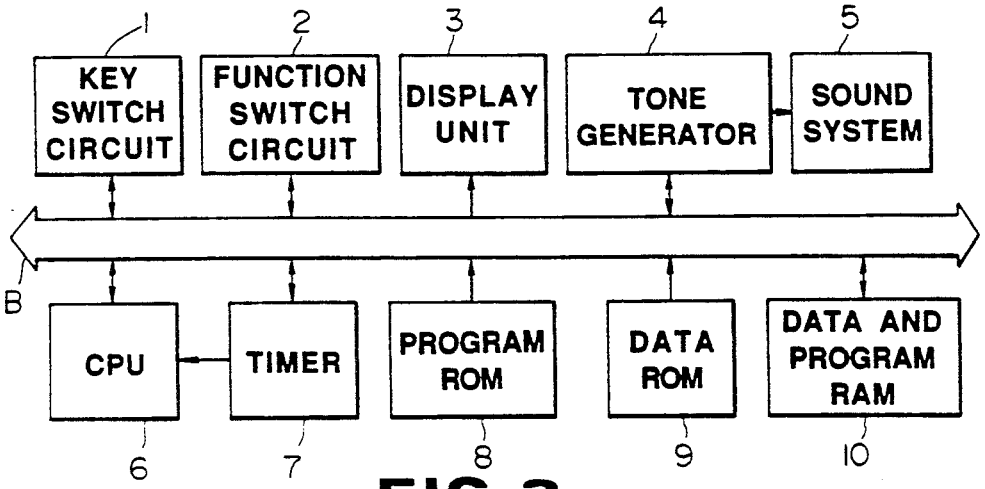
FIG. 3
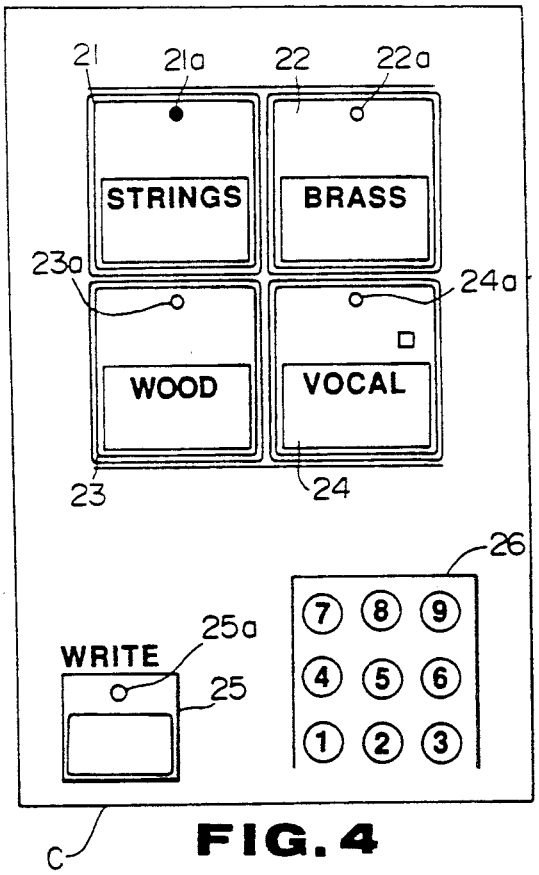
FIG. 4
1 STRINGS
VIOLIN NO 1
FIG. 5 (a)
2 BRASS
TROMBONE NO 2
FIG. 5 (b)
3 WOOD
BASSOON NO 2
FIG. 5 (c)
* VOICE *
PIANO 1 NO 42
FIG. 5 (d)

AN ELECTRONIC MUSICAL INSTRUMENT HAVING SWITCHES FOR DESIGNATING MUSICAL TONE CONTROL DATA

BACKGROUND OF THE INVENTION

1. Field of the Invention

The present invention relates to electronic musical instruments, and in particular, to operational factors for musical tone control operators for electronic musical instruments.

2. Prior Art

Electronic musical instruments are conventionally known for which the designation of tone generation control parameters is carried out by various timbre and rhythm designation operators arrayed on a control panel. When operation of these operators is detected, appropriate operational parameters are subsequently provided to the pertinent circuitry for each type of timbre and automatic rhythm function. A portion of an operational control panel for a conventional electronic musical instrument is shown in FIG. 1. As can be seen in the drawing, an array of timbre switches corresponding to each of the various types of timbre control available is provided on the control panel. When the individual operating the instrument desires to activate one of the available timbre functions, the operator presses the switch displaying the desired function, whereby the appropriate timbre function is designated. The array of automatic rhythm control switches for the same electronic musical instrument is shown in FIG. 2. Similar to the designation of timbre control functions, when the operator desires to activate one of the available automatic rhythm control functions, by pressing the switch displaying the desired function, the appropriate type of rhythm control is established.

With another type of conventional electronic musical instrument, rather than an individual switch corresponding to each available timbre and rhythm control function, each switch controls a number of timbre or rhythm control functions, thus making it possible to decrease the total number of operational control switches on the control panel. With such a musical instrument a record is kept of the number of times an individual switch is pressed and a suitable timbre or rhythm control function is designated depending on the press count for a particular switch. As an example of this type of instrument in which one control switch activates a predetermined set of timbre or rhythm control functions based on the number of times the switch has been pressed, an implementation has been disclosed in Japanese Utility Model Application Second Publication "kokoku" No. 58-1833.

With the first above described approach to timbre and rhythm control designation, in which a separate corresponding switch is provided for each type of timbre and rhythm control function available, the large array of operational control switches necessitates a control panel with a considerably large switch mounting surface area. For the operator, such an arrangement presents the problem of searching for the switch which designates a desired function among a large array of operational control switches, thus leading to operating characteristics for the musical instrument which are less than optimal. With the type of instrument in which one control switch activates a predetermined set of timbre or rhythm control functions depending on the number of times the switch has been pressed, for an instrument having a large number of available timbre and rhythm control functions, it often becomes necessary to press a particular switch some large number of times in order to select a desired function, thus requiring significant time. This is particularly troublesome when the operator wishes to select or change a function in the midst of a performance.

SUMMARY OF THE INVENTION

In consideration of the above, it is an object of the present invention to provide an electronic musical instrument for which selection of, for example, timbre, rhythm, reverberation control functions etc. can easily be carried out by a performer, and for which the necessary control panel surface area can be reasonably small, even when the instrument has a large number of available timbre, rhythm and other control functions.

As a means to attain this object, the present invention provides an electronic musical instrument employing various types of musical tone control data which are divided into groups. Additionally, the electronic musical instrument of the present invention provides an input means which includes a plurality of switches, each switch corresponding to one of the above described groups of musical tone control data, the input means being capable of detecting the operation of the above mentioned switches. Additionally provided is a tone control data management means wherein designation data is stored to indicate which of the above mentioned groups of musical tone control data have been selected, the designation data being updated any time one of the above mentioned switches corresponding to a group of musical tone control data has been operated. Also, a musical tone control means is provided whereby based on the above mentioned designation data, musical tone control data is selected, and based on the selected musical tone control data, musical tone control is effected.

With an arrangement as described above, the designation data used for selection of musical tone control data is updated based on operation of switches, each switch corresponding to a group of musical tone control data. When the designation data is thus updated, based on the designation data corresponding to each group of musical tone control data, musical tone control data is selected, on which basis musical tone control is effected. Thus it becomes possible to achieve the above stated object of the present invention, as will become clear as the preferred embodiments of the present invention are described in detail in a following section.

BRIEF DESCRIPTION OF THE DRAWINGS

FIG. 3 is a block diagram showing the layout of an electronic musical instrument of a first preferred embodiment of the present invention.

FIG. 4 shows a portion of a control panel employed in the electronic musical instrument shown in FIG. 3.

FIGS. 5(*a*)–(*d*) show an example of the operation of an indication panel employed in the electronic musical instrument shown in FIG. 3.

DETAILED DESCRIPTION OF THE PREFERRED EMBODIMENTS

Figure 1:
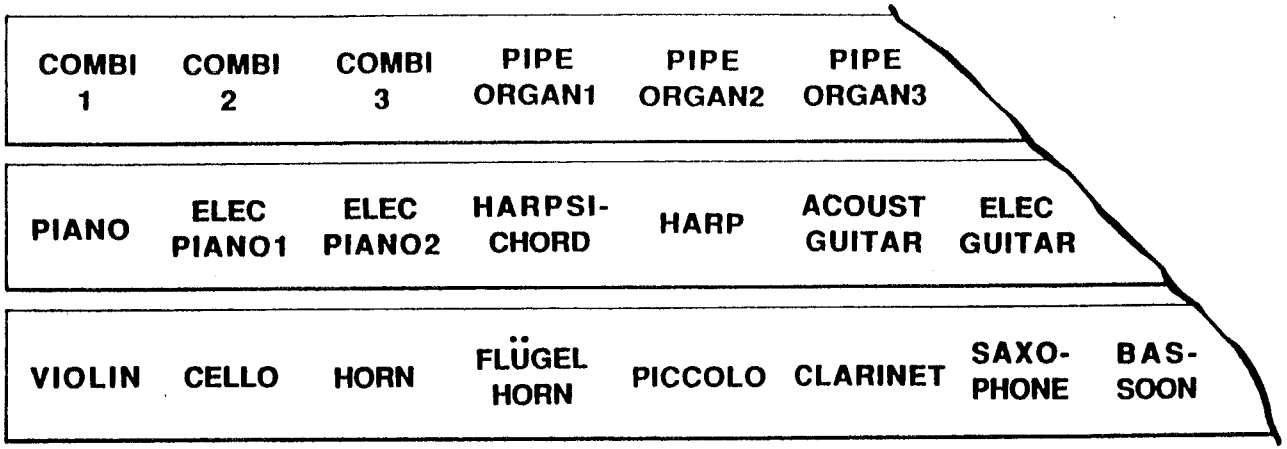
FIG. 1 shows an example of timbre switches employed in a conventional electronic musical instrument.
Figure 2:
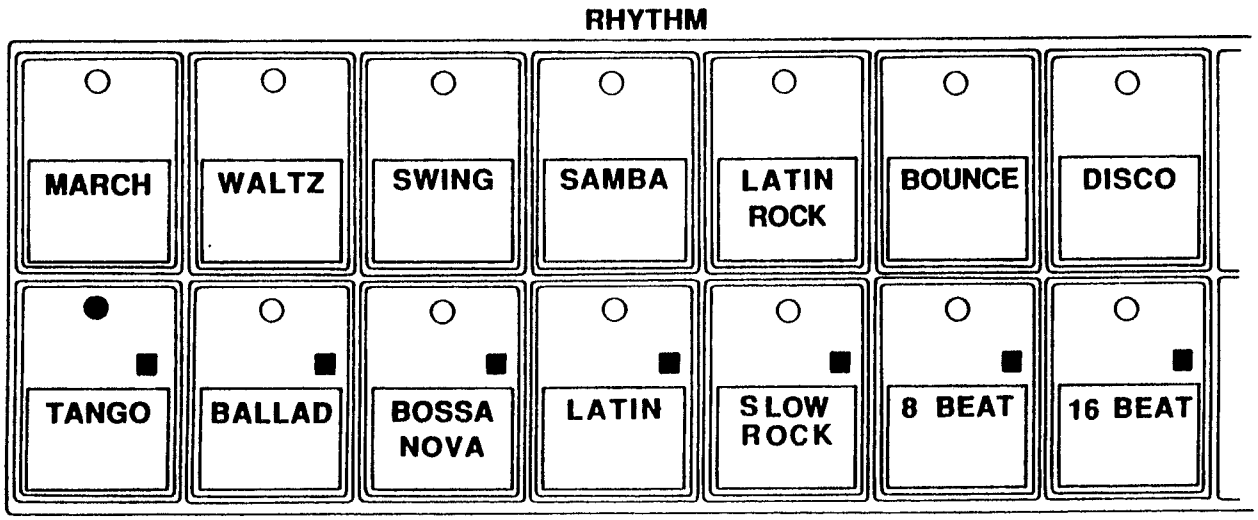
FIG. 2 shows an example of rhythm designation switches employed in a conventional electronic musical instrument.

In FIG. 3, a block diagram showing the layout of an electronic musical instrument of a first preferred embodiment of the present invention is shown. Shown in the diagram is a key switch circuit 1, wherein operation of the keys (key-on, key-off) of a keyboard device is detected. Function switch circuit 2 detects the on/off state of each of the various types of function switches, encompassing all of the timbre switches of the control panel of the electronic musical instrument of the present invention. Display unit 3 displays the currently selected timbre number, timbre name, and the like. Musical tones are formed in tone generator 4 and the musical tones thus formed are then provided to sound system 5 wherein musical sound is generated. The overall operation of the electronic musical instrument is controlled by CPU (central processor unit) 6, to which an interrupt signal is continuously supplied at a fixed frequency by timer 7. A control program for the control of the overall operation of the electronic musical instrument is stored in program ROM (read only memory) 8, and data ROM 9 stores various control data used when the control program stored in program ROM 8 is under progress, as well as various other types of data tables. Data is temporarily stored in RAM (random access memory) 10. Key switch circuit 1, function switch circuit 2, display unit 3, tone generator 4, CPU 6, timer 7, program ROM 8, data ROM 9, and RAM 10 are connected in common via bus B.

In the electronic musical instrument of the present embodiment, as with the conventional electronic musical instrument shown in FIG. 1, timbre switches are provided, whereby a timbre can be designated by the operator by pressing the timbre switch corresponding to the desired timbre. In addition to these timbre switches, the electronic musical instrument of the present embodiment provides timbre group designation switches 21, 22 and 23 white button write switch 25 and ten keys 26, as is shown in FIG. 4 on control panel C. An LED (light emitting diode) 21*a*–25*a* is provided respectively in each of group designation switches 21, 22 and 23, white button 24, and write switch 25. A respective LED 21*a*–25*a* is illuminated for each corresponding switch that is in the on state. For each of group designation switches 21, 22 and 23 and white button 24, a respective switch number (1–4) is assigned. Additionally, all of the timbre switches are assigned a switch number, starting with 5 and ascending. Through the assignment of switch numbers, when one or more of the switches is in the on state, the corresponding switch number is supplied to CPU 6 via function switch circuit 2, whereby appropriate processing is initiated.

In the following, a description of timbre and timbre group will be presented. With the electronic musical instrument of the present embodiment, a timbre number has been assigned to each timbre. By designating a timbre number (to be described below), the appropriate timbre parameters are supplied to tone generator 4, whereby a timbre is established. As is shown in Table 1 below, each timbre is allocated to one of four groups.

TABLE 1

| Timbre Group | Instrument Type | Timbre Number | Timbre Name |
|---|---|---|---|
| 1 | strings | 11 | violin |
| | | 12 | viola |
| | | etc. | |
| 2 | brass | 21 | trumpet |
| | | 22 | trombone |
| | | etc. | |
| 3 | woods | 31 | clarinet |
| | | 32 | bassoon |
| | | etc. | |
| 4 | other | 41 | piano 1 |
| | | 42 | piano 2 |
| | | etc. | |

Thus, as can be seen in Table 1 above, each timbre available for the electronic musical instrument is allocated to one of four groups, timbre group one for string instruments, timbre group two for brass instruments, timbe group three for wood instruments, or timbre group four for any other type of instrument or musical sound. For timbres falling within timbre groups one through three, and tens place, that is, the second digit to the left of the decimal point for the timbre number is given by the respective timbre group number. In the case of timbres allocated to timbre group four, since the number of possible timbres is quite large, the tens place for the timbre number can be given by any digit value of four or greater.

For the above described group designation switches 21, 22 and 23, each one corresponds to a respective timbre group, one to three. The appropriate timbre group name, i.e. "STRINGS", "BRASS" or "WOODS" is inscribed on each respective group designation switch 21, 22 and 23, whereby the operator can discern the appropriate switch when it is desired to initiate or change a timbre group. By designating a timbre group by pressing the respective group designation switch 21, 22 or 23, the operator can then designate one of the timbres within designated timbre group, thus establishing a timbre in tone generator 4, as will be described further on.

Concerning white button 24, with the electronic musical instrument of the present embodiment, a timbre number selected through the action of a performer can be written to memory in a memory area referred to as the white button region, and additionally, a timbre number which has previously been registered in the white button region can be used to establish a timbre in tone generator 4. When the white button 24 is pressed, the timbre number stored in the white button area is read out.

In the following, the display of timbre number and timbre name will be described for the electronic musical instrument of the present embodiment. A liquid crystal dot matrix display panel is connected with display unit 3, where the timbre number and name can be displayed. In FIGS. 5(*a*) to 5(*d*), each of the display formats are shown. In the case when one of timbre groups one to three have been selected, the timbre number selected from within the respective timbre group is displayed as is shown in one of the formats of FIGS. 5(*a*) to 5(*c*). With the display formats shown in FIGS. 5(*a*) to 5(*c*), in the left upper corner, "1", "2" or "3" is displayed, corresponding to the designated timbre group. In the central part of the display, the timbre group name or instrument family, for example "STRINGS", "BRASS", "WOODS", etc., is horizontally displayed in Roman characters, below which the timbre name, example "VIOLIN", "TROMBONE", "BASSOON", etc., is horizontally displayed in Roman characters. At the lower right corner of the display, the first digit to the left of the decimal point of the timbre number is displayed, for example "NO. 1", "NO. 2", "NO. 2" in the case where "VIOLIN", "TROMBONE", "BASSOON" are displayed, respectively. When the timbre has been designated using white button 24, or when ten keys 26 input has been effected, the timbre name and number is displayed according to the display format shown in FIG. 5(*d*). In this case, the timbre group number is not shown, and the timbre number is shown as two digits. The control program whereby the various display formats are changed from one to another is stored in ROM 8. Based on the method of designating timbre, and on the designated timbre group, the control program directs CPU 6 to display the appropriate display format.

Figure 6:
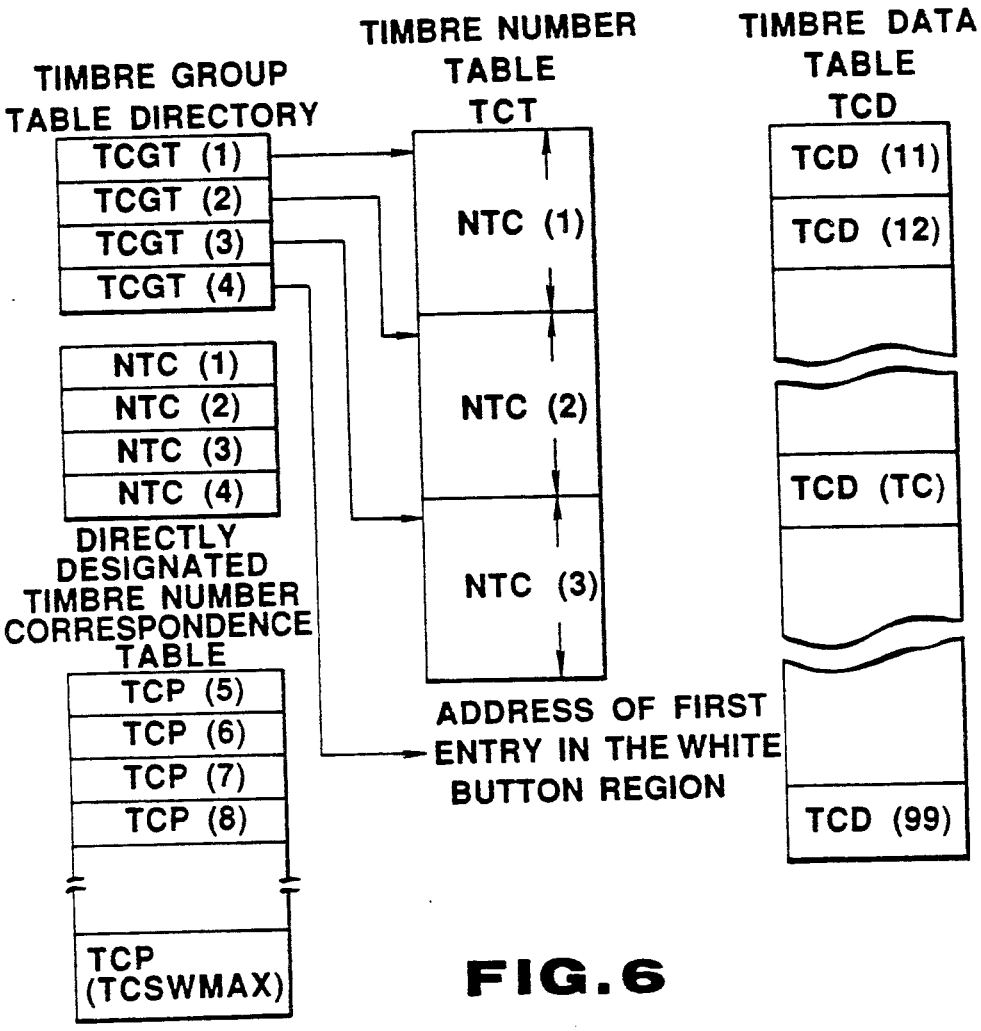
FIG. 6 shows the data structures registered in ROM employed in the electronic musical instrument shown in FIG. 3.

In the following, the various data tables stored in data ROM 9 will be described. Examples of some of these table types are shown in FIG. 6.

Timbre Number Table TCT: The Timbre Number Table is a sequential listing of timbre numbers with one entry for every timbre available in the electronic musical instrument, the $i^{th}$ entry given by TCT(i), where i equals from [1] through N, N being the aggregate number of timbres available.

Timbre Data Table TCD: In this data table, the necessary parameters for format:,on of musical tones (envelope wave form parameter, modulation rate when a frequency modulated tone generator 4 has been employed, and the like) as well as timbre name data are stored for corresponding one of the timbres from timbre number 11 to timbre number 99.

Timbre Group Table Directory TCGT: Each entry in the Timbre Group Directory Table contains address information for one of various tables as well as other data, including entries TCGT(1) to TCGT(3) which contain the address of the first timbre number for timbre groups one through three respectively in the above described timbre number table. Entry TCGT(4) contains the address of the first entry in the previously described white button region memory area (as will be described below, this area is also known as the White Button Table TCWH). Additionally, entries NTC(1) to NTC(3) contain the number of individual timbres in each of timbre groups one through three respectively. In entry NTC(4), the number of timbres stored in the white button region memory area (White Button Table TCWH) is registered.

Directly Designated Timbre Number Correspondence Table TCP: The Directly Designated Timbre Number Correspondence Table contains entries from TCP(5) to TCP(TCSMAX), where TCSMAX is the switch number for the timbre switch having the largest switch number. Each entry in the Directly Designated Timbre Number Correspondence Table contains the corresponding timbre number for each timbre switch used for directly designating timbres, thus excluding the timbre group designation switches and the white button.

Figure 7:
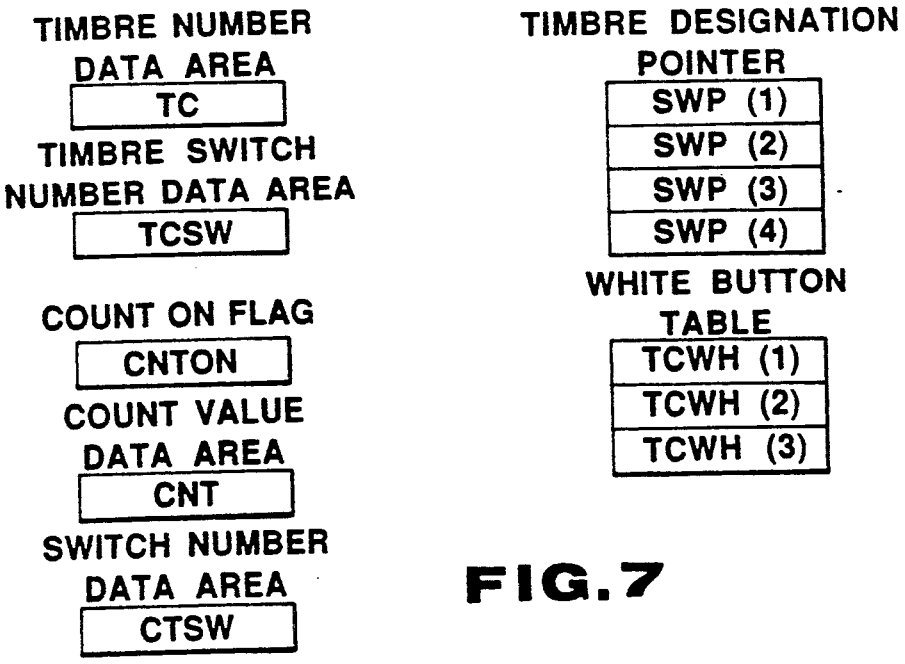
FIG. 7 shows the data structures stored in RAM employed in the electronic musical instrument shown in FIG. 3.

In the following, the various data tables and other data entries temporarily stored in RAM 10 during operation of the electronic musical instrument of the present embodiment will be described. Examples of some of the data structures registered in RAM 10 are shown in FIG. 7.

Timbre Number Data Area TC: For the timbre number stored in the Timbre Number Data Area TC, the corresponding timbre parameters are established in tone generator 4.

Timbre Switch Number Data Area TCSW: When one of the timbre group designation switches 21, 22, 23, the white button 24, or any other timbre switches have been pressed, the corresponding switch number is stored in the Timbre Switch Number Data Area TCSW.

Switch Number Data Area CTSW: A copy of the data stored in the above described Timbre Switch Number Data Area TCSW is stored in this data area whenever the value is between [1] to [4]. Otherwise, the Switch Number Data Area CTSW is set to zero.

Count On Flag CNTON: Whenever one of the timbre group designation switches 21, 22, 23 or the white button 24 have been pressed, this flag is set to [1]. Then, after the counter interrupt routine (to be described later on) has executed a predetermined number of times, this flag is cleared to zero.

Count Value Data Area CNT: This data area stores the number of times the counter interrupt routine (to be described later on) has executed after the above described Count On Flag CNTON has been set to [1].

Timbre Designation Pointer SWP(1) to SWP(4): Whenever one of the timbre group designation switches 21, 22, 23 or the white button 24 has been designated, for the timbre which is to be supplied to tone generator 4, a numerical value indicating its position in the series of timbres registered in timbre group 1, timbre group 2, timbre group 3, or the white button region memory area (White Button Table TCWH) is stored in Timbre Designation Pointer SWP(1), SWP(2), SWP(3), or SWP(4), respectively.

White Button Table TCWH(1) to TCWH(3): These tables represent the memory area for the white button region memory area in the electronic musical instrument of the present embodiment. Each data entry in these tables consists of a timbre number.

In the following section, the operation of the electronic musical instrument of the present embodiment will be described, with reference to the flow charts presented in FIGS. 8 through 13.

Figures 8, 9:
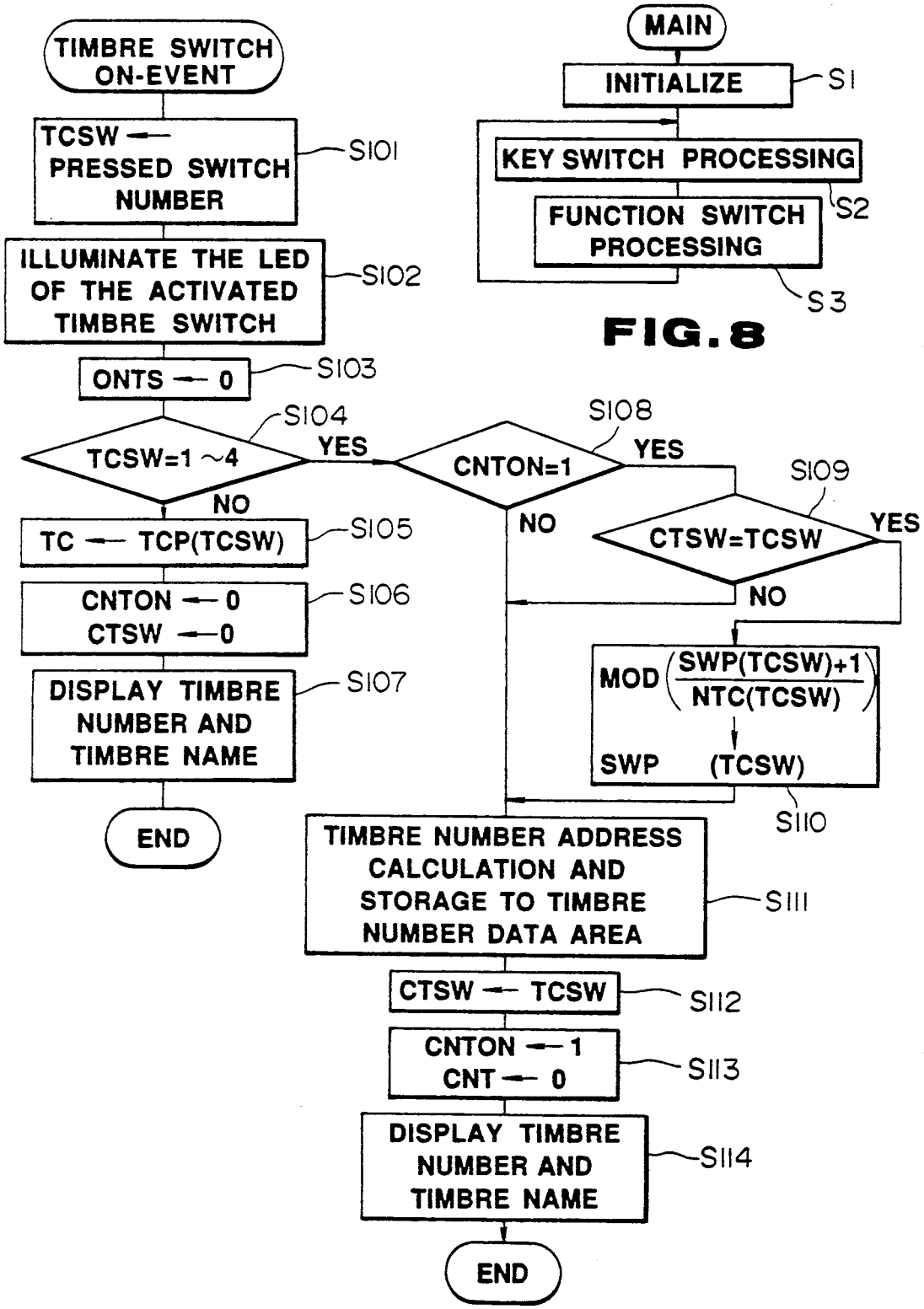
FIGS. 8 through 13 are flow charts showing program flow for the various routines included in a program as carried out by the CPU employed in the electronic musical instrument shown in FIG. 3.

After the power switch is turned on, thus supplying electrical power from the power supply to the other components in the electronic musical instrument of the present embodiment, CPU 6 proceeds to execute the main routine of a control program stored in program ROM 8, as shown by the flow chart of FIG. 8. As can be seen in the drawing, immediately after power is supplied, the tables and other data areas in RAM 10 are initialized (step Sl). During this initialization, timbre numbers for different tone types are registered in the White Button Tables TCWH(1) to TCWH(3) as initial values. After initialization has been completed, key switch processing and function switch processing is consecutively repeated in steps S2 and S3, respectively.

During the above mentioned key switch processing (step S2), key-on events and key-off events are detected, and appropriate corresponding control data (pitch data corresponding to the key number, and data indicating to commence and terminate tone generation) are supplied to tone generator 4, whereby tone generation is effected. In the case where timbre group designation switches 21, 22, 23, white button 24 or other timbre switches are in the on state, the function switch processing (step 3) directs CPU 6 to execute the timbre switch on-event processing routine shown in the flow chart of FIG. 9.

Timbre Designation Using the Timbre Group Designation Switches or White Button When an on-event by timbre group designation switches 21, 22, 23, white button 24 or other timbre switches is detected by function switch circuit 2, CPU 6 executes the timbre switch on-event processing routine shown in the flow chart of FIG. 9. First of all, in step S101, the switch number for the switch for which an on-event has been detected is stored in the Timbre Switch Number Data Area TCSW. Next, the LED corresponding to the activated timbre switch is turned on (step S102), after which the ten keys flag ONTS is cleared to zero (step S103). The above mentioned ten keys flag ONTS indicated when numerical values are being input via the previously mentioned ten keys 26, in which case the flag is set to [1] (to be described later). Next, in step S104, a determination is made as to whether the contents of the Timbre Switch Number Data Area TCSW is a value from [1] to [4], or not.

When the above described judgement in step S104 is [No], that is, when an individual timbre switch has been turned on, rather than the timbre group designation switches 21, 22, 23 or white button 24, the routine proceeds to step S105. In step S105, an entry from TCP(5) to TCP(TCSMAX) in the Directly Designated Timbre Number Correspondence Table in data ROM 9 indexed by the value in the Timbre Switch Number Data Area TCSW, that is, the entry at TCP(TCSW) is stored in the Timbre Number Data Area TC. When this occurs, among the values stored in the Timbre Data Table TCD, the parameters registered at the entry indexed by the value stored in the Timbre Number Data Area TC are supplied to tone generator 4, whereby the timbre is established. Next, in step S106, the Count On Flag CNTON is cleared to zero, and at the same time, zero is written to the Switch Number Data Area CTSW. After completion of step S106, the timbre number previously stored in the Timbre Number Data Area TC, as well as the corresponding timbre name which is stored in the Timbre Data Table TCD at the entry indexed by the value stored in the Timbre Number Data Area TC are supplied to display unit 3 (step S107). As a result, a display format analogous to the one shown in FIG. 5(d) is shown on the display panel, thus displaying the timbre name and timbre number. At this point, the timbre switch on-event processing routine in CPU 6 terminates.

When the timbre switch on-event processing routine commences after the operator has pushed the group designation switch 21, in step S101, the switch number [1] is written to the Timbre Switch Number Data Area TCSW. Next, the LED for group designation switch 21 is turned on (step S102), after which the ten keys flag ONTS is cleared to zero (step S103). Next, in step S104, when it is determined that the contents of the Timbre Switch Number Data Area TCSW is a value from [1] to [4], [1] in this case, a judgement of [YES] is made and the routine jumps to step S108.

In step S108, a judgement is made as to whether the Count On Flag CNTON is set, that is, if the Count On Flag CNTON holds a [1]. When the result of this judgement is [YES], the routine proceeds to step S109. When the result of the judgement is [NO], the routine proceeds to step S111. Thus, when the Count On Flag CNTON holds a zero, the routine proceeds to step S111.

When the routine has proceeded to step S111, there the the address for the target timbre number in the Timbre Number Table TCT is calculated. That is, the entry in the Timbre Group Table Directory TCGT corresponding to the value stored in the Timbre Switch Number Data Area TCSW (equals [1] when the active group designation switch is switch 21), thus the value at TCGT(TCSW), in other words TCGT(1), is determined, to which is added the value held at the Timbre Registration Pointer SWP(TCSW), after which [1] is subtracted. As has been described earlier, the value at TCGT(1) contains the address of the first timbre number for timbre group one in the timbre number table TCT, that is, the base address for timbre group one in the timbre number table TCT. Thus, by adding the pointer value at Timbre Registration Pointer SWP(TCSW) to the base address for timbre group one in timbre number table TCT, then subtracting [1], the address for the target timbre number in the Timbre Number Table TCT can be calculated. The timbre number in the Timbre Number Table TCT indexed by the above calculated address is then lead out and written to the Timbre Number Data Area TC.

Under the present circumstances, the Timbre Designation Pointers SWP(1) through SWP(4) have been initialized to [1] in the above described initialization process (step S1 in FIG. 8). Thus, it can be seen that when the group designation switch 21 has been pressed, the timbre number read from the Timbre Number Table TCT and stored in the Timbre Number Data Area TC is the timbre number indexed by TCGT(1), which is the address of the first timbre entry for timbre group 1 in the Timbre Number Table TCT:

$$\begin{aligned} TCGT(TCSW) + SWP(TCSW) - 1 &= TCGT(1) + SWP(1) - 1 \\ &= TCGT(1) + 1 - 1 \\ &= TCGT(1) \end{aligned}$$

After the calculations in step S111, the routine proceeds to step S112 where the contents of the Timbre Switch Number Data Area TCSW are copied to the Switch Number Data Area CTSW, after which in step S113, the Count On Flag is set to [1] and the Count Value Data Area CNT is cleared to zero. Next, in step S114, the timbre number stored in the Timbre Number Data Area TC and the timbre name registered in the Timbre Data Table TCD corresponding to the timbre number are sent to display unit 3. As a result, the timbre number and timbre name are displayed according to the display format shown in FIG. 5(*a*) on the display panel.

In the above description, the case where the group designation switch 21 has been pressed was used as an example, however the operation is entirely analogous when group designation switches 22, 23 or white button 24 has been pressed. In the case where the white button 24 has been pressed, the address of the first entry for the White Button Tables TCWH(1) through TCWH(3) in RAM 10 is referenced by entry TCGT(4) in the Timbre Group Table Directory TCGT. Thus, when the white button 24 has been pressed, the first timbre number entry for the White Button Tables TCWH is read out and stored in the Timbre Number Data Area TC:

$$\begin{aligned} TCGT(TCSW) + SWP(TCSW) - 1 &= TCGT(4) + SWP(4) - 1 \\ &= TCGT(4) + 1 - 1 \\ &= TCGT(4) \end{aligned}$$

When timbre group designation switches 21, 22, 23, or white button 24 has been activated, the display according to FIGS. 5(*a*), 5(*b*), 5(*c*) or 5(*d*), respectively is presented on the display panel.

As has been mentioned previously, an interrupt signal is continuously sent to CPU 6 at a fixed frequency by timer 7. Each time it receives an interrupt signal, CPU 6 temporarily halts the routine in progress and executes the interrupt routine shown in FIG. 10. In this interrupt routine, first of all, in step S201, a judgement is made as to whether the Count On Flag CNTON is set to [1] or not. In the case where the result of the judgement is [NO], the interrupt routine terminates and the interrupted routine regains control. When the result of the judgement is [YES], the interrupt routine proceeds to step S202 where the value held in the Count Value Data Area CNT is incremented by [1]. Next, in step S203, a judgement is made as to whether the value held in the Count Value Data Area CNT is greater than a predetermined value ENDT or not. The value for ENDT is a constant stored in program ROM 8. In the case where the result of the judgement is [NO], the interrupt routine terminates and the interrupted routine regains control. When the result of the judgement is [YES], the Count On Flag CNTON is cleared to zero in step S204 after which the interrupt routine terminates and the interrupted routine regains control. In this way, even though the Count On Flag CNTON has been set to [1], after a predetermined length of time when ENDT repetitions of the interrupt routine have occurred, the Count On Flag CNTON is again cleared to zero.

In the following, a description will be given of the electronic musical instrument of the present embodiment for the case where the group designation switch 21 has been pressed a second time. In this case, as in the previous description, the routine shown in FIG. 9 executes up to step S108 where a judgement is made as to whether the Count On Flag CNTON is set to [1] or not. When a short period of time has passed since the group designation switch 21 was first pressed, the Count On Flag CNTON will be set to [1], and accordingly, a judgement of [YES] is made in step S108 after which the routine proceeds to step S109. In step S109, a judgement is made as to whether the content of the Switch Number Data Area CTSW is equal to the content of the Timbre Switch Number Data Area TCSW or not, that is, a judgement is made as to whether the switch pressed this time is the same as the switch pressed the last time or not. When the result of the judgement is [YES], the routine proceeds to step S110. In the case where the result of the judgement is [NO], the routine proceeds to step S111 where the timbre corresponding to the activated group designation switch is determined, the timbre is reset, and the new timbre name and number is displayed. In the case where the result of the judgement is [YES], and the routine proceeds to step S110, where [1] is added to the Timbre Designation Pointer SWP corresponding to the value stored in Timbre Switch Number Data Area TCSW (1 in the present example), that is, [1] is added to SWP(TCSW). In the same step S110, the result of the addition is divided by the total number of available timbres in the designated group NTC(TCSW) (in the present example, the aggregate number of timbres in timbre group one NTC(1)), and the remainder from the division becomes the new Timbre Switch Number Data Area TCSW , after which the new value for the Timbre Registration Pointer SWP(TCSW) is determined. In this way, the value for the Timbre Registration Pointer SWP(TCSW) becomes incremented. In the case where the value for the Timbre Registration Pointer SWP before the incrementation was the largest value for the designated group, that is, when the value for the Timbre Registration Pointer SWP before the incrementation is SWP(TCSW), the new Timbre Registration Pointer SWP becomes [1].

After completing step S110, in step S111, the timbre corresponding to the incremented Timbre Registration Pointer SWP is determined, and the corresponding timbre number is stored in the Timbre Number Data Area TC. Afterwards, the routine proceeds through steps S112, S113 and S114 as has been described earlier.

When a longer period of time has passed since the group designation switch 21 was first pressed, the Count On Flag CNTON will be cleared to zero, and accordingly, a judgement of [NO] is made in step S108 after which the routine proceeds to step S111. In this case, the Timbre Registration Pointer SWP has not been incremented. Thus, the timbre number determined in step S111 is the same as the previously determined value.

Timbre Designation Using Ten-Keys

With the electronic musical instrument of the present embodiment, timbre groups one through three are designated by pressing group designation switch 21, 22 or 23 respectively, whereby the tens place for the timbre number is selected. After so doing, the ones place for the timbre number corresponding to the desired timbre can be selected using the ten-keys 26. In the following section, timbre selection through combined use of group designation switches 21, 22, 23 and the ten keys 26 will be described.

When an individual operating the instrument selects a timbre group by pressing, for example group designation switch 21, the timbre switch on-event processing routine shown in FIG. 9 is begins to execute. Thus, the number of the pressed group designation switch, in this case [1] for group designation switch 21, is written to the Switch Number Data Area CTSW (step S112), the LED on the pressed group designation switch is illuminated (step S102), the timbre corresponding to the active timbre group and the initial value (1) of the Timbre Registration Pointer SWP is established in tone generator 4 (step S112), and corresponding timbre name and timbre number are displayed on the display panel (step S114).

Figure 11:
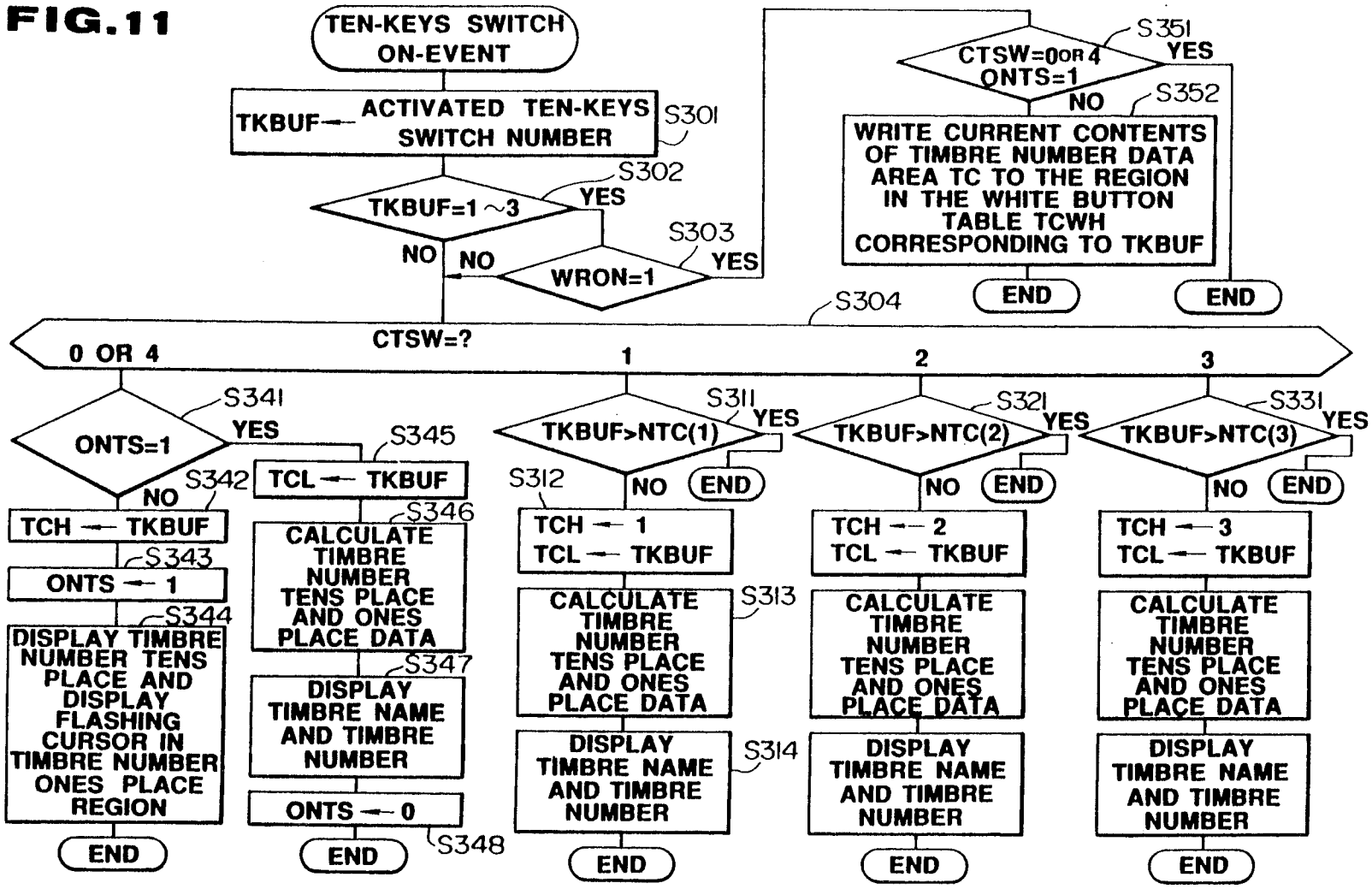
Figure 10:
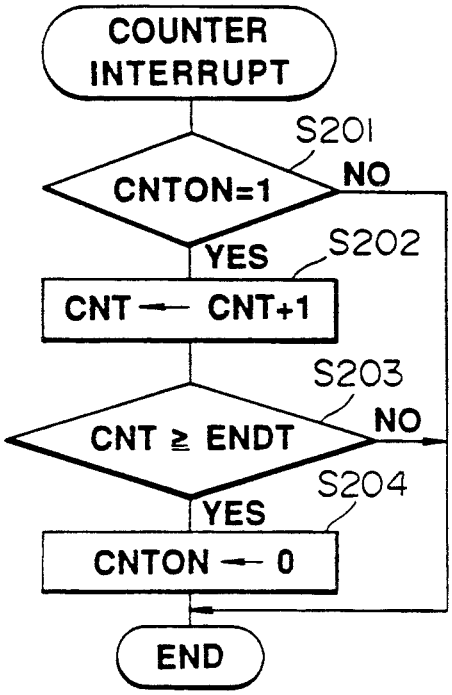

When one of the ten-keys 26 which are shown in FIG. 4 is pressed, for example ten-keys switch number one, the ten-keys on-event is sensed by function switch circuit 2, whereby the ten-keys switch on-event processing routine shown in FIG. 11 is initiated by CPU 6.

In the ten-keys switch on-event processing routine, first of all, the number of the activated ten-keys switch is stored in the ten-keys buffer TKBUF in step S301. Next, in step S302, a judgement is made as to whether the content of the ten-keys buffer TKBUF is from [1] to [3], or not. When the result of this judgement is [YES], the routine proceeds to step S303. When it is judged that the ten-keys buffer TKBUF holds a value other than [1], [2] or [3], the routine proceeds to step S304. In step S303, a judgement is made as to whether the content of the write flag WRON is [1] or not. With the present electronic musical instrument, whenever the previously mentioned write switch 25 is in the off state, the write flag WRON is set to [0]. With this kind of configuration, when the result of the judgement in step S303 is [NO], the routine proceeds to step S304. The results of a judgement of [YES] in step S303 will be described further on.

When the result of the judgement in step S303 is [NO], and the routine proceeds to step S304, a branch decision is made. Thus, in step S304 a judgement is made based on the content of the Switch Number Data Area CTSW. That is, when the content of the Switch Number Data Area CTSW is [0] or [4] the routine branches to step S341, when the content of the data area is [1] the routine branches to step S311, when the content is [2] the routine branches to step S321, and when the content of the Switch Number Data Area CTSW is [3] the routine branches to step S331. In the present example where the ten-keys switch number one has been pressed, the content of the Switch Number Data Area CTSW is [1], and thus, the routine proceeds to step S311. In step S311, a judgement is made as to whether the content of the ten-keys buffer TKBUF is greater than the total number of timbre numbers for the designated timbre group, or not, that is, for the present example (timbre group one), a judgement is made as to whether the content of the ten-keys buffer TKBUF is greater than NTC(1) or not. When the result of this judgement is [NO], as in the present example, the routine proceeds to step S312. When the judgement is [YES], that is, when it is judged that the numerical value for the selected ten-keys switch is greater than the total number of available timbres in the designated timbre group, a ten-keys input error is judged to have occurred and the procedure is terminated.

Having proceeded to step S312, the timbre number tens place data area TCH is set to [1] and the value stored in the ten-keys buffer TKBUF ([1] in this example) is written to the timbre number ones place data area TCL. Next, in step S313, from the values stored in the timbre number tens place data area TCH and the timbre number ones place data area TCL in the previous step S312, the timbre number is calculated and the result of the calculation ([11] in the present example) is written to the Timbre Number Data Area TC. By this sequence, the timbre number [11] comes to be established in tone generator 4. Then, in step S314, the timbre name corresponding to the timbre number stored in the Timbre Number Data Area TC is read out, and the timbre name, along with the value stored in the timbre number low address data area TCL is sent to display unit 3. As a result, the timbre number and name are displayed on the display panel according to the display format shown in FIG. 5(*a*).

In the case where group designation switch 22 has been pressed, rather than group designation switch 21 as in the preceding example, at step S304, the routine branches to step S321. When group designation switch 23 has been pressed, at step S304, the routine branches to step S331. In both of these cases, just as when group designation switch 21 was been pressed, the number for the selected timbre group is stored in the Switch Number Data Area CTSW as timbre tens place data, and the number of the selected ten-key is used for timbre ones place data. Analogous to when group designation switch 21 has been selected, when group designation switch 22 or 23 has been selected, the timbre name timbre number is displayed on the display panel according to the format of FIG. 5(*b*) or 5(*b*), respectively.

With the electronic musical instrument of the of the present embodiment, it is possible to use the ten-keys 26 for designation of both the tens place and the ones place of the timbre number. In the following, operation of the musical instrument in that case will be described.

When an individual operating the musical instrument presses one of the ten-keys 26, the ten-keys switch on-event routine shown in FIG. 11 is executed. When the ten-keys switch on-event routine is executing in this circumstance, first of all, the number of the pressed ten-keys switch is stored in the ten-keys buffer TKBUF (step S301). Next, in step S302, a judgement is made as to whether the content of the ten-keys buffer TKBUF is from [1] to [3], or not. When the result of this judgement is [NO], the routine proceeds to step S304. When the result of this judgement is [YES], the routine proceeds to step S303. In the present example where one of the ten-keys 26 has been pressed, the judgement is [NO], and the routine proceeds to step S304.

In step S304, the previously described branch decision is carried out. When the operator has pressed the white button 24 prior to the ten-keys 26 input, the Switch Number Data Area CTSW holds the value of [4]. When the operator has pressed a timbre switch other than group designation switches 21, 22, 23 or white button 24, the Switch Number Data Area CTSW holds the value of [0]. And, when the operator has pressed neither the group designation switches 21, 22, 23, white button 24, nor other timbre switches, the Switch Number Data Area CTSW holds the value of [0]. Thus, in each of the above circumstances, the Switch Number Data Area CTSW holds the value of [4] or [0], and thus the routine proceeds from step S304 to step S341. In step S341, a judgement is made as to whether the ten-keys flag ONTS holds a value of [1] or not. In the present example, since this is the first ten-keys 26 data input, the ten-keys flag ONTS holds a value of [0] and the result of the judgement is [NO]. Thus, the routine proceeds to step S342.

In step S342, the value stored in the ten-keys buffer TKBUF is written to the timbre number tens place data area TCH. Next, in step S343, the ten-keys flag ONTS is set to [1]. In step S344, the value stored in the timbre number tens place data area TCH is sent to display unit 3, and the tens place value is displayed in the tens place region on the display panel. At this time, since the ones place value for the timbre number has not yet been input, only a blinking cursor is displayed in the ones place region on the display panel (step S344). At this point, the routine terminates.

In the present state, when the operator inputs the ones place value for the timbre number using the ten-keys 26, the ten-keys switch on-event routine shown in FIG. 11 is again executed. In this case, the routine proceeds through steps S301 to S304, and then branches to step S341 just as before. Then, in step S341, the result of the judgement is [YES], so the routine proceeds to step S345, when the content of the ten-keys buffer TKBUF is written to the timbre number ones place data area TCL. Next, in step S346, from the content of the timbre number tens place data area TCH and the timbre number ones place data area TCL, the timbre number is calculated, and the result of the calculation is stored in the Timbre Number Data Area TC, after which the corresponding parameters are established in tone generator 4. Next, in step S347, the timbre name data corresponding to the timbre number is read out from the timbre data table, after which the timbre name and timbre number are supplied to the display unit 3. As a result, the timbre name and timbre number are displayed on the display panel according to the display format shown in FIG. 5(*d*).

Writing a Timbre Number to the White Button Region

When the timbre number currently stored in the Timbre Number Data Area TC is written to the White Button Table TCWH, the individual operating the electronic musical instrument sets the Write Flag WRON to one by pushing the write switch 25, after which the operator inputs the write destination in the White Button Table TCWH using the ten-keys 26.

Figure 12:
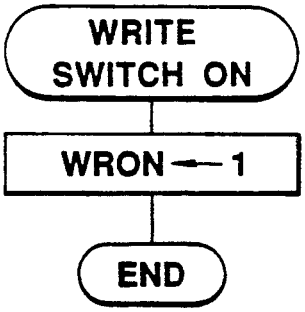
Figure 13:
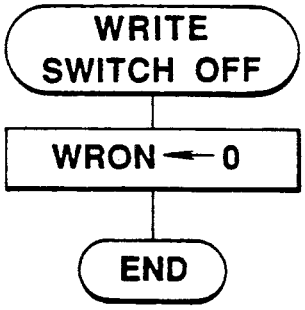

The Write Flag WRON, as will be explained below, alternates between set to one and cleared to zero each time the write switch 25 is pressed. That is, when the electronic musical instrument detects that the write switch 25 has been pressed, a flip-flop (not shown in the drawings) that is provided is toggled between set and cleared. In the present embodiment, when the output of the flip-flop is one, the write switch 25 is [ON] and when the output of the flip-flop is zero, the write switch 25 is [OFF]. When the output of the flip-flop is one, the write switch on-event processing routine shown in FIG. 12 is executed, and the Write Flag WRON is set to one. When the output of the flip-flop is zero, the write switch off-event processing routine shown in FIG. 13 is executed, and the Write Flag WRON is cleared to zero. Accordingly, by operation of the write switch 25, the operator can toggle the Write Flag WRON between one and zero.

When the Write Flag WRON has been set to one, in this state when a numerical value is then input via the ten-keys 26, the tens switch on-event processing routine shown in FIG. 11 is executed. In this case, the routine proceeds through step S301 to step S302, where a judgement is made as to whether the content of the ten-keys buffer TKBUF is [1], [2], [3] or not. In the electronic musical instrument of the present embodiment, the white button memory region is made of a write destination designated by a value other than [1], [2] or [3] would be without effect. Accordingly, only when a judgement of [YES] has been made in step S302, that is, only when the content of the ten-keys buffer TKBUF is [1], [2] or [3], the routine proceeds to step S303.

In step S303, since the value of the Write Flag WRON is [1], the judgement is [YES] and the routine proceeds to step S351. In step S351, a judgement is made as to whether the content of the Timbre Switch Number Data Area TCSW is [0] or [4], and the Ten-Keys On Flag is [1], or not. When the result of this judgement is [YES], that is, when it is judged that only tens place for the timbre number has been input via the ten-keys 26, input error handling is initiated and the routine is terminated. On the other hand, when the result of the judgement in step S351 is [NO], in step S352, the content of the Timbre Number Data Area TC is written to the entry in the White Button Table TCWH(TKBUF) corresponding to the value held in the ten-keys buffer TKBUF, after which the routine is terminated. In this way, the number of the timbre currently in effect is written to the white button memory region.

Figure 14:
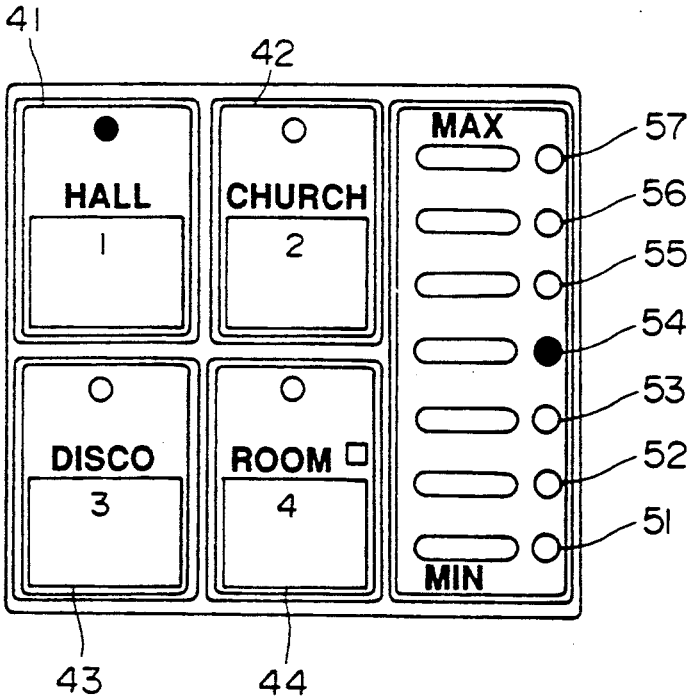
FIG. 14 shows switches employed in a variation of the electronic musical instrument of the present invention, whereby various types of reverberation effects are selected.

In the above described first preferred embodiment of the present invention, a suitable implementation of a timbre designation means has been described. However, the present invention should not be considered to be so limited. For example, in a suitable implementation, rhythm functions could be divided into a plurality of rhythm groups, for each of which a separate rhythm group designation switch is provided. Such an implementation may be suitably designed so that, each time a given rhythm group designation switch is pressed, for example a "disco" rhythm group designation switch, the designated rhythm group changes from "disco 1" to "disco 2" to "disco 3", and then back to "disco 1", each being a related type of rhythm within the "disco" rhythm group. As another example, as shown in FIG. 14, designation switches 41 through 44 for reverberation effects corresponding to different surroundings, for example "hall", "church", "disco", and "room", can be provided, along with and array of LEDs 51 through 57 for indicating the area of the reverberation chamber, each successive LED indicating a successively larger chamber. With such a design, for example each time the "hall" switch is pressed, the reverberation function can change from "hall 1" to "hall 2" to "hall 3 " and back to "hall !", each indicating a successively larger hall. In this case, each time the "hall" switch is pressed, the illuminated LED changes from LED 51 to LED 52 to LED 53 and back to LED 51 thus indicating the size of the hall. In consideration of the above, the description of the preferred embodiments in the specification of the present invention should be regarded as suitable examples and not as limitations. Thus, the present invention should be considered to include all embodiments encompassed by the appended claims.

What is claimed is:

1. An electronic musical instrument comprising:

a) memory means for storing musical tone control data representing a plurality of control data groups;

b) a plurality of switches, each switch corresponding to one of the plurality of control data groups;

c) control means, responsive to a first operation of at least one of the plurality of switches, for reading from the memory means a first of musical tone control data from a control data group corresponding to the operated switch, wherein the control means reads a different set of musical tone control data within the control data group corresponding to the operated switch with each subsequent operation of the at least one switch; and d) musical tone generating means for generating a musical tone signal based the musical tone control data read from the memory means.

2. An electronic musical instrument according to claim 1, wherein each of the plurality of control data groups corresponds to a predetermined instrument group, and wherein the musical tone control data within a specified control data group represents a plurality of timbres.

3. An electronic musical instrument according to claim 1, wherein the predetermined instrument group includes at least one of strings, brass, and wood instruments.

4. An electronic musical instrument according to claim 1, wherein each of the plurality of control data groups corresponds to a predetermined rhythm group, and wherein the musical tone control data within a specified control data group represent a plurality of rhythms.

5. An electronic musical instrument according to claim 1 further including clock means for determining a time interval between operations of each of the plurality of switches, wherein the control means is responsive to the clock means such that, for first and second consecutive operations of one of the plurality of switches, if the time interval between the first and second operations of the one switch is less than a predetermined amount, the control means reads musical tone control data from the memory means which is different from the musical tone control data read at the first operation of the one switch.

* * * * *